US005311213A

United States Patent [19]

Kosugi

[11] Patent Number: 5,311,213

[45] Date of Patent: May 10, 1994

[54] DISPLAY CONTROL DEVICE

[75] Inventor: Satoshi Kosugi, Kanagawa, Japan

[73] Assignee: Mitsubishi Denki Kabushiki Kaisha, Tokyo, Japan

[21] Appl. No.: 946,801

[22] Filed: Sep. 16, 1992

Related U.S. Application Data

[63] Continuation of Ser. No. 591,039, Oct. 1, 1990, abandoned.

[30] Foreign Application Priority Data

Sep. 29, 1989 [JP] Japan ..... 1-254761

[51] Int. Cl.[5] ..... G09G 1/02

[52] U.S. Cl. ..... 345/194; 345/192

[58] Field of Search ..... 340/799, 798, 735, 750; 395/150, 164; 345/192, 193, 194, 185, 141

[56] References Cited

U.S. PATENT DOCUMENTS

| | | | |
|---|---|---|---|
| 4,075,620 | 2/1978 | Passavant et al. | 340/324 |
| 4,165,506 | 8/1979 | Brands et al. | 340/799 |
| 4,345,244 | 8/1982 | Greer et al. | 340/799 |
| 4,422,070 | 12/1983 | Couper et al. | 340/723 |
| 4,595,996 | 6/1986 | Morley et al. | 340/799 |
| 4,604,712 | 8/1986 | Orrhammar | 340/799 |

FOREIGN PATENT DOCUMENTS

| | | |
|---|---|---|
| 0283579 | 9/1988 | European Pat. Off. . |
| 3138930 | 4/1983 | Fed. Rep. of Germany . |

*Primary Examiner*—Ulysses Weldon
*Assistant Examiner*—Doon Chow
*Attorney, Agent, or Firm*—Wolf, Greenfield & Sacks

[57] ABSTRACT

A display control device according to the present invention includes a common memory having two functions, one as a refresh memory for outputting a character code and the other as a character generator for generating a character font, an output character code from which is stored in a line buffer. In this case, a display address generator circuit generates a character address for generating the character code and a raster address for designating the character font, which are in turn switched by an address selector and outputted to said common memory which then outputs a video signal to a video control circuit based upon said character font. Additionally, there is provided a line buffer control circuit for outputting a read/write access control signal to said line buffer based upon the raster address.

9 Claims, 2 Drawing Sheets

DISPLAY CONTROL DEVICE

This application is a continuation of application Ser. No. 07/591,039, filed Oct. 1, 1990, now abandoned.

BACKGROUND OF THE INVENTION

1. Field of the Invention

The present invention relates to a code refreshing display control device for displaying character information on various displays such as a raster scanning CRT display and a liquid crystal, etc.

2. Description of the Prior Art

Referring to FIG. 2, the construction of a character display system of a prior code refreshing display control device is illustrated in the form of a block diagram. In the figure, designated at 1 is a display address generator circuit for generating a display address in given display timing, 7 is a refresh memory into which character code information is written corresponding to a display position on a display screen and of which the same is read out following a character address from said display address generator circuit 1, 8 is a character generator in which a specific style character font is stored in a ROM or a RAM corresponding to a character code and which is to generate a corresponding character font by a character code read from the refresh memory 7, and 6 is a video control circuit into which output data from the character generator 8 is inputted for generating various video signals suitable for a display device.

Here will be described operation of the prior display control device. The display address generator circuit 1 generates in a predetermined period a character address as an address of the refresh memory 7 corresponding to a display screen, and a raster address of a character to the character generator 8. The refresh memory 7, in which a character code has previously been written corresponding to a display position on a display screen, and outputs as data a character code in an area addressed by the foregoing character address. The character code is inputted into the character generator 8 together with the foregoing raster address as a character address of a corresponding character font. The character generator 8 then outputs the character font as data. The video control circuit 6 converts the output data from the character generator 8 to a video signal for display, and supplies a signal suitable for the display device to the same. Hereby, the display device displays the character on its display screen.

The prior code refreshing display control device is constructed as described above, and generally incorporates a RAM as the refresh memory and a ROM or a RAM as the character generator, requiring physically a plurality of types of independent memories and hence a complicated control circuit for a plurality of memory accesses. Further, use of a plurality of types of memories makes difficult the realization of space saving of a parts packaging area, of cost reduction, lowering of troubles, and so on.

SUMMARY OF THE INVENTION

In view of the drawbacks with the prior art, it is an object of the present invention to provide a display control device which is capable of reduction of the number of parts as an entire device, space saving, cost reduction, and reliability improvement as a result of lowering troubles by providing a common memory serving as the refresh memory and the character generator.

To achieve the above object, a display control device according to the present invention comprises a common memory 4 having functions as a refresh memory for outputting a character code and a character generator for generating a character font, a display address generator circuit 1 for generating a character address for designating a character code stored in said common memory 4 and a raster address for designating a character font, a line buffer 5 for storing therein a character code outputted from said common memory 4, an address selector 3 for switching the character address from said display address generator circuit 1 and the character code from said line buffer 5, and outputting a so-switched signal to said common memory 4, a video control circuit 6 for outputting a video signal based upon the character font from said common memory 4, and a line buffer control circuit 2 for outputting a read/write access control signal that is to perform read/write operation with respect to said line buffer 5 based upon the raster address from said display address generator circuit 1.

The above and other objects, features, and advantages of the invention will become more apparent from the following description when taken in conjunction with the accompanying drawings.

DESCRIPTION OF THE PREFERRED EMBODIMENT

Figure 1:
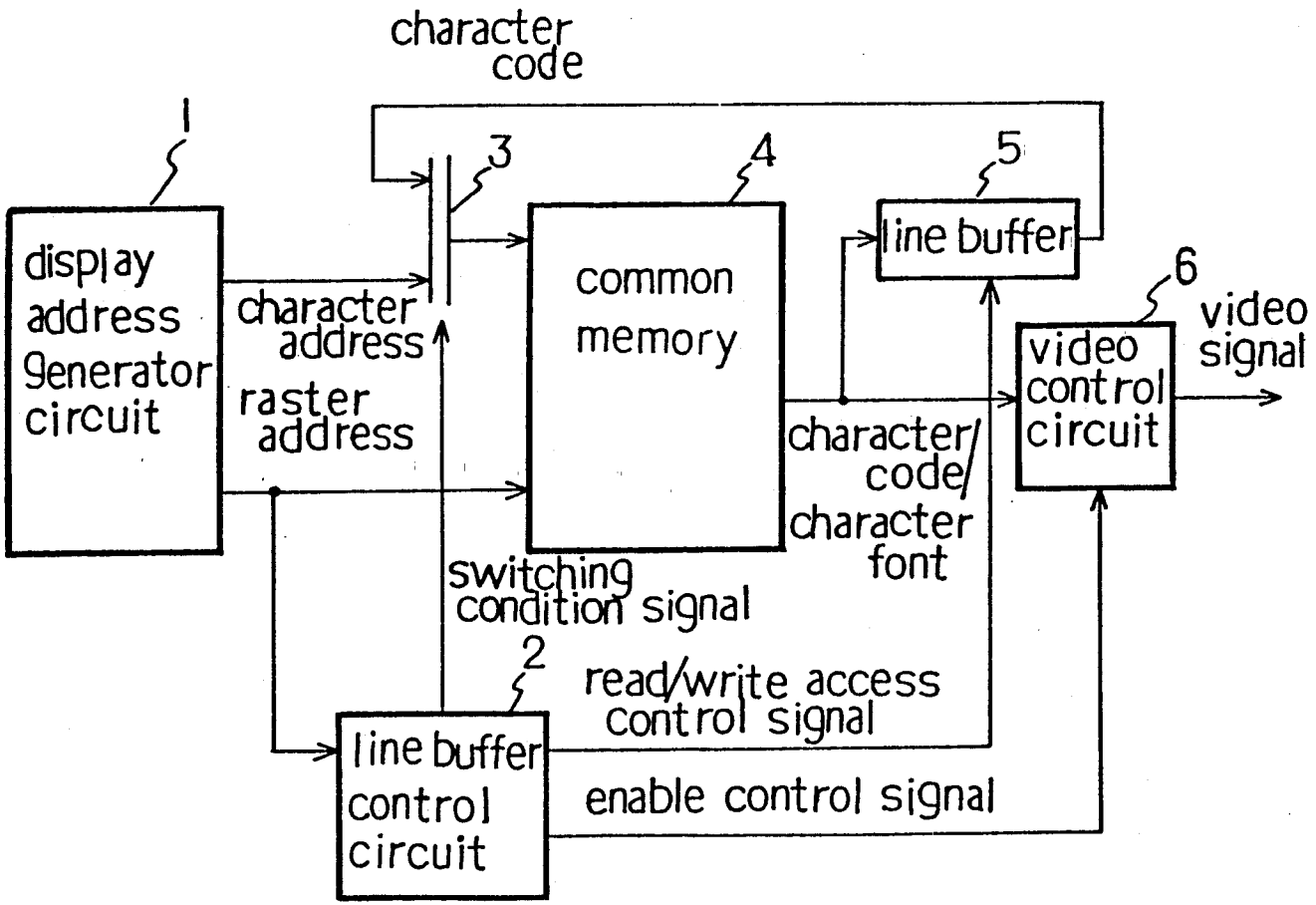
FIG. 1 is a block diagram illustrating the construction of a character display system of a display control device according to an embodiment of the present invention.
Figure 2:
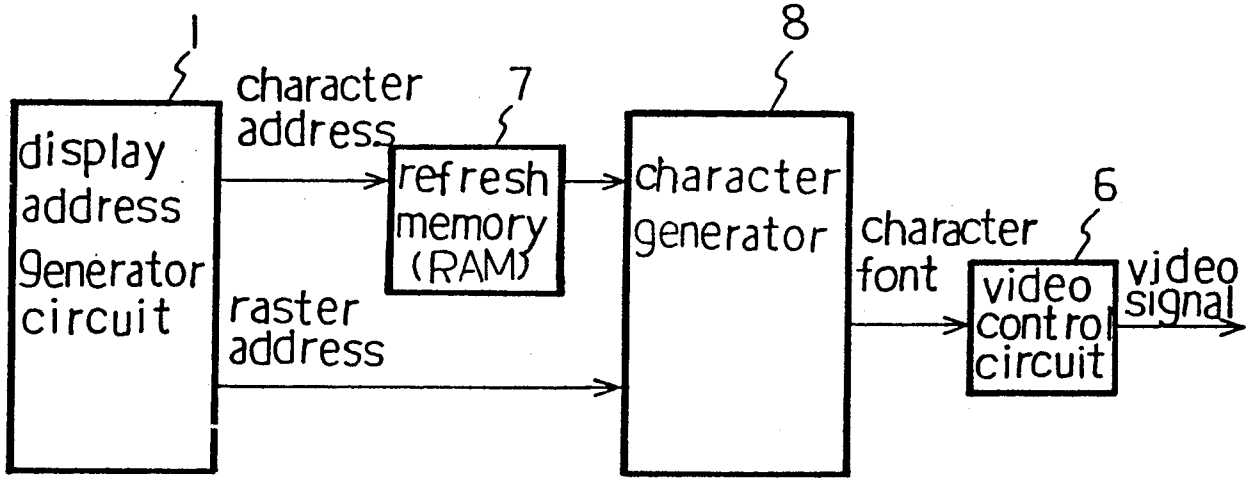
FIG. 2 Prior Art
FIG. 2 is a block diagram illustrating the construction of a character display system of a prior display control device.

Referring to FIG. 1, the construction of a character display system of a display control device according to an embodiment of the present invention is illustrated in the form of a block diagram. As illustrated in the figure, designated at 4 is a common memory having two functions, one of a refresh memory for outputting a character code, the other of a character generator for generating a character font, 1 is a display address generator circuit for generating a character address for designating a character code stored in the common memory 4 and a raster address for designating a character font, 5 is a line buffer for storing therein a character code outputted from the common memory 4, 3 is an address selector for switching a character address from the display address generator circuit 1 and a character code from the line buffer 5, 6 is a video control circuit for outp tting a video signal based upon a character font from the common memory 4, and 2 is a line buffer control circuit for outputting a read/write access control signal for instructing the line buffer 5 to effect read/write operation based upon a raster address from the display address generator circuit 1 and further outputting a switching condition signal for the address selector 3 and an enable control signal for the video control circuit 6. The common memory 4 comprises a one chip memory having a storage capacity more than the total sum of those of the refresh memory 7 and of the character generator 8 in the prior example. Herein, the common memory 4 may comprise a plurality of chips, but is rather desirable to comprise one chip memory in order to reduce the number of constituent parts. The line buffer 5 comprises a register which has a storage capacity corresponding to the number of one horizontal line of display characters, and the like.

Operation of the embodiment constructed as described above is as follows. When a raster address outputted from the display address generator circuit 1 indicates a head raster of a display character for example, the common memory 4 starts to act as the refresh memory. The line buffer control circuit 2 receives the raster address from the display address generator circuit 1 and decodes the same to judge whether or not it is a head raster. If the signal is the head raster, it outputs a switching condition signal to the address selector 3 such that the character address from the display address generator circuit 1 is inputted into the common memory 4 during the one horizontal display period. The common memory 4 outputs a character code corresponding to the display screen by inputting therein the character address. The line buffer control circuit 2 also outputs to the line buffer 5 write control signals (write access control signals) such as a write enable signal and a write clock signal, etc., such that the character code outputted from the common memory 4 during this period is written into the line buffer 5, and further outputs a disable signal to the video control circuit 6 to mask the video signal to be outputted to the display device.

When the raster address outputted from the display address generator circuit 1 indicates a signal other than the head raster, the common memory 4 acts as the character generator. At this time, the line buffer control circuit 2 outputs the switching condition signal to the address selector 3 such that a character code stored in the line buffer 5 is inputted into the common memory 4 as an address. The common memory 4 outputs the character font previously stored therein by inputting the character code thereinto. Additionally, the line buffer control circuit 2 outputs various read control signals (read access control signals) such as a read enable signal and a read clock, etc., to the line buffer 5 such that the line buffer 5 issues the character code written therein at the head raster corresponding to the display screen, and outputs the enable signal to the video control circuit 6 to control the common memory 4 such that the character font outputted from the common memory 4 is fed to the display device.

The display control device in the present embodiment described above can have two types of functions of the refresh memory and the character generator with a memory of one type such as a RAM by the use of the line buffer in which the character code corresponding to the one horizontal display to stored. The common memory acting as the refresh memory and the character generator is first accessed as the refresh memory by the character address outputted from the display address generator circuit, and data stored in the common memory is stored in the line buffer. Successively, the line buffer operates as the refresh memory whilst a next line character is displayed, to output the character code periodically, which is in turn received by the common memory that is hereby accessed as the character generator. These operations are repeated corresponding to the number of lines following a format of the display screen to display the associated character on the display device.

It should be noticed that although in the above embodiment the block diagram only of the circuit of the character display system in the code refreshing display control device was illustrated for simplification, the embodiment is also applicable to a device incorporation an attribute control circuit for controlling a ruled line and display colors.

Additionally, although in the above embodiment the case was described where the single memory acts both as the code refresh memory and the RAM character generator, a device incorporating the ROM character generator in the prior example may also be applicable.

Furthermore, although the case was described by way of an illustrative example where a character code was written in the line buffer at the head raster, it may be written at any raster, e.g., at a final raster, and any raster to be written may be set in a programmable manner. Moreover, although the video signal was made disable upon the character code being written into the line buffer, the video signal may be made enable at all times by controlling write timing by an external circuit. Additionally, although in the above embodiment, the line buffer control circuit, the address selector, and the line buffer were described as belonging in separate independent blocks, they may be united into a common memory control block to reduce the number of required circuits as well as achieve space saving of a parts packaging area.

According to the present invention, as described above, the display control device comprises the common memory having the functions of the refresh memory and the character generator, the display address generator circuit for generating a character address and a raster address, the line buffer for storing therein a character code outputted from the common memory, the address selector for switching a character address from the display address generator circuit and a character code from the line buffer, and outputting a switched address to the common memory, the video control circuit for outputting a video signal based upon the character font from the common memory, and the line buffer control circuit for outputting a read/write access control signal to the line buffer based upon the raster address from the display address generator circuit, whereby there can be assured the reduction of parts as the entire device, space saving, cost reduction, and improved reliability by the reduction of troubles.

What is claimed is:

1. A display control device comprising:

a) a common memory having functions of a refresh memory for outputting a character code and a character generator for generating a character font;

b) a display address generator circuit for generating a character address signal for designating the character code stored in said common memory and a raster address signal for designating the character font;

c) a line buffer, responsive to a read/write access control signal, for storing therein the character code outputted from said common memory, wherein said line buffer comprises a register having a storage capacity corresponding to the number of display characters in one horizontal line;

d) an address selector, responsive to a switching condition signal, for switching the character address signal from said display address generator circuit and the character code from said line buffer to output a switched signal to said common memory;

e) a video control circuit, responsive to an enable control signal, for outputting a video signal based upon the character font from said common memory; and f) a controller, responsive to the raster address signal, for outputting the read/write access control signal for instructing said line buffer to effect read/write operation based upon the raster address signal from said display address generator circuit, for outputting the enable control signal to said video control circuit based upon the raster address signal and for outputting the switching condition signal to said address selector based upon the raster address signal, wherein said controller comprises decoding means, receiving the raster address signal from said display address generator circuit, for decoding the raster address signal to determine whether it is indicative of a head raster, wherein said controller comprises control means, responsive to decoding of the raster address signal, for, if a head raster is present, generating the switching condition signal for providing by said address selector of the character address signal from said display address generator circuit to said common memory, and for generating, in response to decoding of a head raster, the read/write access control signal to said line buffer and said enable control signal to said video control circuit for writing a character code from said common memory into said line buffer and for disabling said video control circuit to mask its output, said decoding means otherwise for producing the switching condition signal for providing the character code from said line buffer to said common memory as an address, for producing the read/write access control signal such for outputting the character code stored in said line buffer, and for producing the enable control signal for outputting from said video control circuit a character font from said common memory.

2. A display control device according to claim 1 wherein said common memory comprises a one-chip RAM.

3. A method for controlling a display device, said method utilizing a display address generator circuit for generating a character address and a raster address, an address selector selectively producing the character address or the output of a line buffer, a memory receiving the output of the address selector and the raster address from the display address generator circuit, the line buffer receiving an output of the memory, a video control circuit receiving the output of the memory, and a line buffer control circuit for controlling the address selector, the line buffer and the video control circuit, said method comprising the steps of:

generating the character address and the raster address from the display address generator circuit;

decoding, at the line buffer control circuit, the raster address to determine whether it is a head raster;

upon decoding a head raster, controlling the address selector, line buffer and video control circuit using said line buffer control circuit, the address selector thereupon providing the character address from the display address generator circuit to the memory, the memory generating a character code in response to the character address signal, the line buffer storing the character code from the memory, and the video control circuit not producing a video output signal;

upon decoding a raster address that is not a head raster, then controlling the address selector, the line buffer and the video control circuit using the line buffer control circuit, the address selector thereupon providing the character code from the line buffer to the memory as an address, the memory producing a character font, the line buffer outputting the character code stored in the line buffer, and the video control circuit producing the character font from the memory as a video output signal.

4. A display control device comprising:

a) a common memory having functions of a refresh memory for outputting a character code and a character generator for generating a character font;

b) a display address generator circuit for generating a character address signal for designating the character code stored in said common memory and a raster address signal for designating only the address of a character font of a video display;

c) a line buffer, responsive to a read/write access control signal, for storing therein the character code outputted from said common memory;

d) an address selector, responsive to a switching condition signal, for switching the character address signal from said display address generator circuit and the character code from said line buffer to output a switched signal to said common memory;

e) a video control circuit, responsive to an enable control signal, for outputting a video signal based upon the character font from said common memory; and f) a controller, responsive to the raster address signal, for outputting the read/write access control signal for instructing said line buffer to effect read/write operation based upon the raster address signal from said display address generator circuit, for outputting the enable control signal to said video control circuit based upon the raster address signal and for outputting the switching condition signal to said address selector based upon the raster address signal, wherein said controller comprises decoding means, receiving the raster address signal from said display address generator circuit, for decoding only the raster address signal to determine whether it is indicative of a head raster, wherein said controller comprises control means, responsive to decoding of the raster address signal, for, if a head raster is present, generating the switching condition signal for providing by said address selector of the character address signal from said display address generator circuit to said common memory, and for generating, in response to decoding of a head raster, the read/write access control signal to said line buffer and said enable control signal to said video control circuit for writing a character code from said common memory into said line buffer and for disabling said video control circuit to mask its output, said decoding means otherwise for producing the switching condition signal for providing the character code from said line buffer to said common memory as an address, for producing the read/write access control signal such for outputting the character code stored in said line buffer, and for producing the enable control signal for outputting from said video control circuit a character font from said common memory.

5. A display control device as claimed in claim 4 wherein the raster address signal does not include an address for a microprocessor to access a common memory but includes only an address of a character font for a video display.

6. A display control device as claimed in claim 4 wherein the decoder only decodes the raster address signal for determining the condition of a head raster.

7. A method for controlling a display device, said method utilizing a display address generator circuit for generating a character address and a raster address only for designating the address of a character font of a video display, an address selector selectively producing the character address or the output of a line buffer, a memory receiving the output of the address selector and the raster address from the display address generator circuit, the line buffer receiving an output of the memory, a video control circuit receiving the output of the memory, and a line buffer control circuit for controlling the address selector, the line buffer and the video control circuit, said method comprising the steps of:

generating the character address and the raster address from the display address generator circuit;

decoding, at the line buffer control circuit, only the raster address signal to determine whether it is a head raster signal;

upon decoding a head raster, controlling the address selector, line buffer and video control circuit using said line buffer control circuit, the address selector thereupon providing the character address from the display address generator circuit to the memory, the memory generating a character code in response to the character address signal, the line buffer storing the character code from the memory, and the video control circuit not producing a video output signal;

upon decoding a raster address that is not a head raster, then controlling the address selector, the line buffer and the video control circuit using the line buffer control circuit, the address selector thereupon providing the character code from the line buffer to the memory as an address, the memory producing a character font, the line buffer outputting the character code stored in the line buffer, and the video control circuit producing the character font from the memory as a video output signal.

8. A method as claimed in claim 7 wherein the raster address signal does not include an address for a microprocessor to access a common memory but includes only an address of a character font for a video display.

9. A method as claimed in claim 7 wherein the decoder only decodes the raster address signal for determining the condition of a head raster.

* * * * *